US006311409B1

(12) United States Patent
Coppa et al.

(10) Patent No.: US 6,311,409 B1
(45) Date of Patent: Nov. 6, 2001

(54) FREEZE DRYING APPARATUS

(75) Inventors: Nicholas V. Coppa, Malvern, PA (US); Paul Stewart; Ernesto Renzi, both of Youngstown, NY (US)

(73) Assignee: The BOC Group, Inc., Murray Hill, NJ (US)

( * ) Notice: Subject to any disclaimer, the term of this patent is extended or adjusted under 35 U.S.C. 154(b) by 0 days.

(21) Appl. No.: 09/255,581

(22) Filed: Feb. 22, 1999

Related U.S. Application Data

(62) Division of application No. 08/716,008, filed on Sep. 19, 1996.

(51) Int. Cl.[7] ..... F26B 5/06
(52) U.S. Cl. ..... 34/92; 34/289
(58) Field of Search ..... 34/284, 285, 286, 34/287, 288, 289, 417, 239, 92, 290, 292, 297

(56) References Cited

U.S. PATENT DOCUMENTS 3,255,534 * 6/1966 Kan ..... 345/298
4,081,914 * 4/1978 Rautenbach et al. ..... 34/92
4,597,188 * 7/1986 Trappier ..... 34/5
4,802,286 * 2/1989 Kobayashi et al. ..... 34/289
5,743,023 * 4/1998 Fay et al. ..... 34/287

* cited by examiner

*Primary Examiner*—Henry Bennett
*Assistant Examiner*—Pamela Wilson
(74) *Attorney, Agent, or Firm*—Salvatore P. Pace

(57) ABSTRACT

The present invention provides methods and apparatus for freeze drying in which a solution, which can be a radioactive salt dissolved within an acid, is frozen into a solid on vertical plates provided within a freeze drying chamber. The solid is sublimated into vapor and condensed in a cold condenser positioned above the freeze drying chamber and connected thereto by a conduit. The vertical positioning of the cold condenser relative to the freeze dryer helps to help prevent substances such as radioactive materials separated from the solution from contaminating the cold condenser. Additionally, the system can be charged with an inert gas to produce a down rush of gas into the freeze drying chamber to also help prevent such substances from contaminating the cold condenser.

8 Claims, 2 Drawing Sheets

FREEZE DRYING APPARATUS

RELATED APPLICATIONS

This is a divisional of application Ser. No. 08/716,008 filed Sep. 19, 1996 now allowed.

This invention was made with Government support under Contract No. W-7405ENG-36 awarded by the U.S. Department of Energy. The Government has certain rights in the invention.

BACKGROUND OF THE INVENTION

The present invention relates to a freeze drying method and apparatus for freeze drying a substance within a freeze drying chamber in which vapor produced by sublimation is condensed within a condensing chamber. More particularly, the present invention relates to such a freeze drying method and apparatus in which the condensing chamber is pressurized prior to the condensation of the moisture in order to help prevent the substance being freeze dried from contaminating the condensing chamber. Even more particularly the present invention relates to such a method and apparatus in which the substance is contained within a solution freeze dried in a bulk freeze drying process involving the freezing of the solution on an array of vertical plates located within the freezing chamber. Still even more particularly, the present invention relates to such a freeze drying method and apparatus that is applied to the decontamination of a solution containing radioactive materials.

Waste disposal problems involving reduction and disposal of radioactive or toxic wastes such as nuclear wastes, wastes containing heavy metals and etc. have long presented an environmental hazard. Such wastes are often processed by dissolving the waste in an acidic solution, for instance nitric acid, and then storing the resultant solution in containers that present a risk of leakage and in any event take up a great deal of storage space. Freeze drying techniques have been applied to such waste disposal problems in order to more properly contain such wastes in a safe and efficient manner. For instance, in U.K. Patent Application GB 2178588, a method and apparatus for treatment for radioactive liquid waste is disclosed in which the radioactive liquid waste is freeze dried to sublimate the solvent and thereby to produce the radioactive solute as a dried deposit.

In any freeze drying process, a substance is frozen within a freeze drying chamber. The substance is then subjected to a reduced pressure while being heated to cause frozen solids to sublimate into vapor. The vapor is condensed within a condensing chamber. In waste disposal applications of freeze drying, it is necessary that the condensing chamber be separated from the freeze drying chamber during the freeze drying process so that condensation chamber does not become contaminated. If such contamination were allowed to occur, radioactively contaminated water would then become a problem which would defeat the whole purpose of the freeze drying process. In order to overcome this problem, in the above referenced U.K. Patent Application, the condensation chamber is segregated from the freeze drying chamber by means of a filter. A filter can, however, limit the size of the freeze dryer because it will reduce the flow of vapor to the condensation chamber.

In the foregoing U.K Patent Application, the freeze drying element located within the freeze drying chamber is a set of pipes. A problem involved with such freeze drying elements is that pipes present a limited surface area and therefore, present another limitation on the size of the freeze drier. Furthermore, any freeze drying element, in addition to presenting a sufficient surface area, must be amenable to removal from the freeze drying chamber for replacement and cleaning purposes.

Although a motivating factor of the present invention is waste treatment, aspects of the present invention have broader applications involving the segregation of the freeze drying process from the environment and the bulk freeze drying of substances within solutions. As will be discussed, the present invention can be generally said to provide a freeze drying method and apparatus in which segregation of the condensation chamber from the freeze drying chamber does not primarily depend on filters. Additionally, freeze drying elements are provided that have sufficient surface area and flexibility for large scale freeze dryer setups.

SUMMARY OF THE INVENTION

In one aspect, the present invention relates to a method of freeze drying a substance in which the substance is frozen in a freeze drying chamber so that a liquid component of the substance is frozen into a solid. The solid is sublimated into vapor and which is then condensed in cold condenser located within a condensation chamber in communication with the freeze drying chamber. Prior to condensing the vapor, the condensation chamber is pressurized with a gas. The pressure within the freeze drying chamber and the condensation chamber is allowed to equalize so that the gas flows from the condensation chamber to the freeze drying chamber, thereby to act to inhibit the solid from entering the condensation chamber. In this aspect of the present invention the substance could be one containing a liquid, for instance a pharmaceutical preparation to be dehydrated, or a liquid solution, which for example could be a radioactive salt dissolved in an aqueous nitric acid solution.

In another aspect, the present invention provides a bulk freeze drying method for separating a substance from a solution. The method comprises introducing the solution into a freeze drying chamber having at least one vertical plate. Part of the solution is frozen on the at least one vertical plate so that solid layers are formed on opposed surfaces of the at least one vertical plate. The remainder of the solution is removed from the freeze drying chamber and the solid layers are sublimated into a vapor so that this substance forms a deposit on the at least one plate. The vapor is condensed on a cold condenser and the deposit is removed from the at least one vertical plate. The deposit is extracted from the freeze drying chamber after having been removed from the at least one vertical plate.

In yet another aspect, the present invention provides a freeze dryer for freeze drying a substance. The freeze dryer comprises a freeze drying chamber having means for freezing the liquid component of the substance into a solid. A means is provided for heating the substance during sublimation of the solid into a vapor. A means is provided for evacuating the freeze drying chamber. A condensation chamber is provided having a cold condenser. The condensation chamber is in communication with the freeze drying chamber for condensing the vapor. An isolation valve is interposed between the cold condenser and the freeze drying chamber for isolating the cold condenser from the freeze drying chamber. A means is provided for pressurizing the condensation chamber with a gas when the condensation chamber is isolated from the freeze drying chamber so that when the isolation valve is set in a open position, pressure within the freeze drying and condensation chambers equalizes to act to inhibit the solid from entering the condensation chamber. In this aspect of the present invention, the substance could be the type of substance of the first mentioned aspect of the present invention.

In yet still another aspect of the present invention, a freeze dryer is provided for separating a substance contained within a solution. The freeze dryer comprises a freeze drying chamber for receiving the solution and at least one vertical plate located within the freeze drying chamber. The at least one vertical plate has passages for circulation of a refrigerant to freeze the solution into opposed solid layers located on the at least one vertical plate and for circulation of a diathermic fluid for heating the plate during sublimation of the solid into a vapor. The sublimation forms a deposit of the substance on the at least one vertical plate. The freeze drying chamber has an inlet for receiving the solution and an outlet for discharging from the freeze drying chamber the remainder of the solution not frozen on the at least one vertical plate. A means is provided for evacuating the freeze drying chamber during the sublimation and a condensation chamber is provided having a cold condenser. The condensation chamber is in communication with the freeze drying chamber for condensing the vapor.

As discussed above, the pressurization of the condensation chamber produces an on rush of gas into the freeze drying chamber to drive the substance back into the freeze drying chamber and away from the condensation chamber. Such pressurization practice of the present invention segregates the condensing chamber from the freeze drying chamber without the use of a filter. It is to be noted that a filter could be used for added security. Additionally, the use of a vertically oriented plate provides much more surface area than a pipe and can be easily replaced by disconnecting the plate from inlet piping to which the plate connects.

BRIEF DESCRIPTION OF THE DRAWINGS

While the specification concludes with claims distinctly pointing out the subject matter that Applicants' regard as their invention, it is believed that the invention will be understood when taken in connection with the accompanying drawings in which:

DETAILED DESCRIPTION

Figure 1:
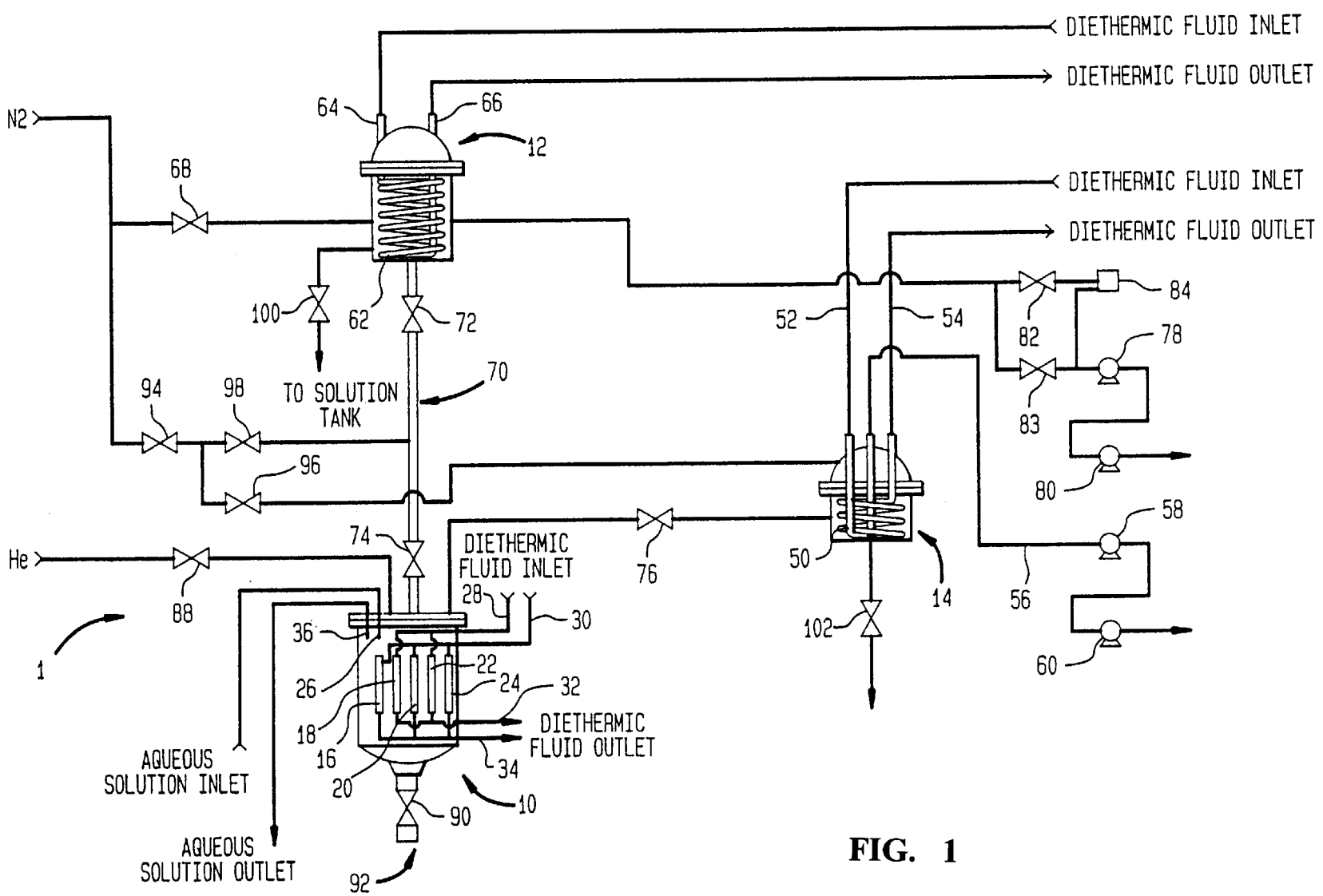
FIG. 1 is a schematic view of a freeze drying apparatus for carrying out a method in accordance with the present invention.

With reference to FIG. 1, a freeze dryer 1 in accordance with the present invention is illustrated. Freeze dryer 1 is specifically adapted to process radioactive wastes. However, this is for exemplary purposes only and the features of Freeze dryer 1 exemplifying the various aspects of the present invention have broader application to the solution of freeze drying problems relating to isolation of the substance being freeze dried from the environment and the bulk freeze drying of solutions.

Freeze dryer 1 is provided with a freeze drying chamber 10 for freeze drying an aqueous solution which can be a nitric acid solution containing radioactive nuclear wastes. Vapor sublimated during the freeze drying of the aqueous solution is condensed within a cold condensing chamber 12. A hot condensing chamber 14 is provided as a cold trap to condense any vapor not condensed within freeze drying chamber 10 during the freeze drying process.

Freeze drying chamber 10 is provided with five vertically oriented plates 16, 18, 20, 22 and 24, but this could be just one or more. During the freeze drying process, a solution is admitted into freeze drying chamber 10 through a freeze drying chamber inlet 26. A refrigerant such as cold diathermic fluid is introduced into and discharged from vertically oriented plates 16–24 through diathermic fluid inlets 28 and 30 and diathermic fluid outlets 32 and 34, respectively. The circulation of the cold diathermic fluid causes a build-up of frozen solution into opposed solid layers on the opposed surfaces of vertically oriented plates 16–24. After a sufficient build-up of solid, excess solution that has not frozen on vertically oriented plates 16–24 is discharged from freeze drying chamber 10 through solution outlet 36.

Figure 2:
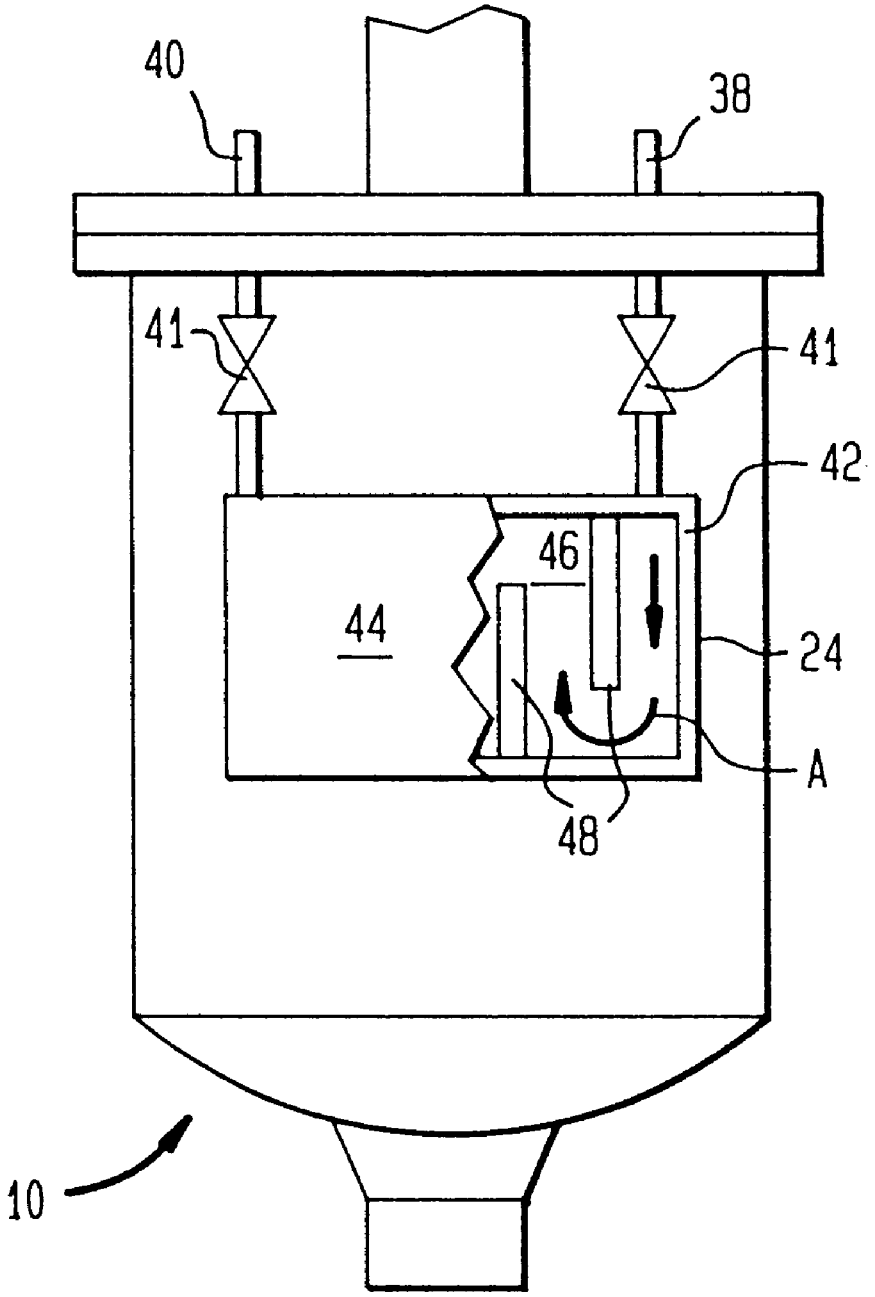
FIG. 2 is an enlarged fragmentary view of FIG. 1 showing details of the attachment of vertical plates within the freeze drying chamber.

With reference to FIG. 2, vertically oriented plate 24 is suspended within freeze drying chamber 10 by provision of a branch 38 of diathermic inlet manifold 28 and a branch 40 of diathermic fluid outlet manifold 32. Quick disconnect fittings 41 can be provided to connect vertically oriented plate 24 to branch 38 and branch 40. Vertically oriented plate 24 has an outer rectangular frame 42 and a pair of first and second rectangular metallic sheets 44 and 46 connected to outer frame 42. Ribs 48 are connected to outer frame 42 and first and second metallic sheets 44 and 46 to provide heat exchange passages within plate 24. Diathermic fluid circulates in the direction of arrowheads A within plate 24 from inlet branch 38 to outlet branch 40.

After removal of excess solution from freeze drying chamber 10, cold diathermic fluid is circulated through a heat exchange coil 50 of hot condensing chamber 14 through diathermic inlet 52 and diathermic outlet 54. Suction applied through vacuum line 56 by booster pump 58 and vacuum pump 60 draws the atmosphere within freeze drying chamber 10 across coils 50 to freeze out any moisture present within such atmosphere. During this stage of the freeze drying process, hot condensing chamber 14 is pumped down to a pressure within a range of about 1 and about 10 torr.

During the foregoing operation of hot condensing chamber 14, cold condensing chamber 12 is activated by passing a flow of diathermic fluid through condensing coil 62. Diathermic fluid enters condensing coil 62 through diathermic fluid inlet 64 and is discharged from condensing coil 62 through diathermic outlet 66. When cold condensing coil 62 is approximately minus 80° C., valve 68 is opened to bleed nitrogen into cold condensing chamber 12 so that cold condensing chamber 12 is approximately 1 torr above the pressure of freeze drying chamber 10 which has been pumped down to between about 1 and about 10 torr by booster pump 58 and vacuum pump 60.

Cold condensing chamber 12 and freeze drying chamber 10 are joined by a conduit 70. It is to be noted that conduit 70 is vertically oriented and, as illustrated, cold condensing chamber 12 is located above freeze drying chamber 10. Valves 72 and 74, which when closed isolate freeze drying chamber 10 from cold condensing chamber 12, open and due to the differential pressure between cold condensing chamber 12 and freezing chamber 10, the down rush of nitrogen occurs through conduit 70. The vertical position of conduit 70 and the down rush of nitrogen inhibit any of the solids produced during freeze drying within freeze drying chamber 10 from contaminating cold condensing chamber 62.

After the opening of isolation valves 72 and 74, a valve 76 between freezing chamber 10 and hot condensing chamber 14 is closed and the sublimation process starts by now circulating heated diathermic fluid through vertically oriented plates 16–24. At the same time, booster pump 78 and vacuum pump 80 are turned on and valve 83 is opened to permit maintenance of vacuum conditions from cold condensing chamber 12 to freezing chamber 10 of a pressure in a range of between about 1 and about 10 torr. In the event that lower pressure conditions are required for the particular mixture being freeze dried, a valve 82 can be opened and a turbomolecular pump 84 can be used to pump down to approximately 0.4 microns. At the conclusion of the sublimation process, valves 72, 74, 82 and 83 are closed and valve 68 is opened. Nitrogen is thereby admitted into condensing chamber 12 in order to raise the pressure of the cold condenser to atmospheric pressure. Additionally, a valve 88 is opened to bring freeze drying chamber up to approximately atmospheric pressure with helium or nitrogen. At the same time a gate valve 90 is opened. The admission of helium or nitrogen into freeze drying chamber 10 knocks particles that have been freeze dried onto vertical plates 16–24 off of such plates and into a collection receptacle 92. At this point, hot condensing chamber 14 and conduit 70 are also backfilled with nitrogen up to about atmospheric pressure by opening valves 94, 96 and 98.

After the backfilling operations, described above, hot diathermic fluid is circulated through cold condensing coil 62 and hot condensing coil 50 in order to melt condensed solutions. A valve 100 can be opened to recirculate melted solutions back to the solution tank for recycling purposes. A valve 102 can be opened to drain hot condensing chamber 14 into a hot solution tank.

Although not illustrated, but as could be appreciated by those skilled in the art, all of the aforementioned valves are of the type that is capable of remote activation. Moreover such activation is preferably controlled by a controller such as a programmable logic computer that is programmed to open and close valves on a timed basis. Also creation and circulation of hot and cold diathermic fluid, also not illustrated, is effectuated in a known manner used in the freeze drying art.

While the invention has been described with reference to preferred embodiment, as will occur to those skilled in the art, numerous changes, additions and omissions can be made without departing from the spirit and scope of the present invention.

We claim:

1. A freeze dryer for freeze drying a substance comprising:

a freeze drying chamber having means for freezing a liquid component of said substance into a solid and means for heating said solid during sublimation of said solid into vapor;

means for evacuating said freeze drying chamber;

a condensation chamber having a cold condenser, said condensation chamber in communication with said freeze drying chamber for condensing said vapor; and an isolation valve interposed between said cold condenser and said freeze drying chamber for isolating said cold condenser from said freeze drying chamber;

means for pressurizing said condensation chamber with a gas when said condensation chamber is isolated from said freeze drying chamber so that when said isolation valve is set in an open position pressure within said freeze drying and condensation chamber equalize, thereby to act to inhibit said solid from entering said condensation chamber.

2. The freeze dryer of claim 1, wherein said condensation chamber is situated above said freeze drying chamber to also inhibit said solid from entering said condensation chamber from said freeze drying chamber.

3. The freeze dryer of claim 1, further comprising a cold trap interposed between said freeze drying chamber and said evacuation means so that said freeze drying chamber is evacuated through said cold trap prior to sublimating said solid in order to trap any of said liquid component not frozen but present within said freeze drying chamber.

4. A freeze dryer for separating a substance contained in a solution, said freeze dryer comprising:

a freeze drying chamber for receiving said solution;

at least one vertical plate located within said freeze drying chamber having passages for circulation of a refrigerant to freeze said solution into opposed solid layers located on said at least one vertical plate and for circulation of a diathermic fluid for heating said plate during sublimation of said solid layers into a vapor, thereby to form a deposit of said substance on said at least one vertical plate;

said freeze drying chamber having an inlet for receiving said solution and an outlet for discharging from said freeze drying chamber a remainder of said solution not frozen on said at least one plate;

means for evacuating said freeze drying chamber during said sublimation; and a condensation chamber having a cold condenser, said condensation chamber in communication with said freeze drying chamber for condensing said vapor.

5. The freeze dryer of claim 4 further comprising:

means for removing said substance from said at least one vertical plate; and means for extracting said substance from said chamber after having been removed from said at least one vertical plate.

6. The freeze dryer of claim 4, further comprising:

an isolation valve interposed between said cold condenser and said freeze drying chamber for isolating said cold condenser from said freeze drying chamber; and means for pressurizing said condensation chamber with a gas when said condensation chamber is isolated from said freeze drying chamber so that when said isolation valve is set in an open position pressure within said freeze drying and condensation chamber equalize, thereby to inhibit said substance from entering said condensation chamber.

7. The freeze dryer of claim 4 or claim 6 wherein said condensation chamber is situated above said freeze drying chamber to inhibit said substance from entering said condensation chamber from said freeze drying chamber.

8. The freeze dryer of claim 4, further comprising a cold trap interposed between said freeze drying chamber and said evacuation means so that said freeze drying chamber is evacuated through said cold trap prior to sublimating said solid layers in order to trap any solution not frozen but present within said freeze drying chamber.

* * * * *